US005722337A

United States Patent [19]

Burt et al.

[11] Patent Number: 5,722,337

[45] Date of Patent: Mar. 3, 1998

[54] CROTCH-FORMING APPARATUS

[75] Inventors: Donald E. Burt, Danvers; Henry R. Cofek, Groton, both of Mass.

[73] Assignee: Design Technology Corporation, Billerica, Mass.

[21] Appl. No.: 770,010

[22] Filed: Dec. 19, 1996

Related U.S. Application Data

[62] Division of Ser. No. 308,667, Sep. 19, 1994, Pat. No. 5,592,890.

[51] Int. Cl.[6] ..... D05B 21/00

[52] U.S. Cl. ..... 112/475.03; 112/470.07; 112/475.09; 271/228

[58] Field of Search ..... 112/475.03, 475.02, 112/475.08, 470.07, 470.06, 470.05, 470.14, 475.09, 306, 153, 470.28, 475.04; 271/228, 227, 184, 185

[56] References Cited

U.S. PATENT DOCUMENTS 5,337,687 8/1994 Moll ..... 112/470.07 X 5,454,335 10/1995 Burt et al. ..... 112/475.03 X 5,568,780 10/1996 Menzin et al. ..... 112/475.03

*Primary Examiner*—Peter Nerbun

*Attorney, Agent, or Firm*—Rhodes Coats & Bennett, L.L.P.

[57] ABSTRACT

An apparatus for forming the crotch in a garment having a front panel and a back panel which are joined at respective ends thereof to form the crotch. A holding fixture engages the front and back panels adjacent to the ends to be joined. A first positioning apparatus positions the ends of the front and back panel in their respective grippers. A second positioning apparatus aligns the edges of the front and back panels with respect to one another. After positioning the front and back panels in their respective grippers, the holding fixture positions the ends of the panels in override flapping relationship. A sewing apparatus is insertable into the holding fixture for sewing the ends of the panel together while the panels are held in the holding fixture.

10 Claims, 13 Drawing Sheets

CROTCH-FORMING APPARATUS

This application is a division of application Ser. No. 08/308,667, filed Sep. 19, 1994, U.S. Pat. No. 5,592,890.

BACKGROUND OF THE INVENTION (1) Field of the Invention

The present invention relates generally to automated manufacturing systems and, more particularly, to an apparatus for joining front and rear fabric panels to form a crotch in a pair of men's briefs or the like.

(2) Description of the Prior Art

The manufacture of textile clothing articles such as briefs, tee-shirts, and other garments has resisted automation. This is due largely because of the difficulty in accurately positioning so called "soft" materials. For example, the knitted material commonly used in briefs and tee-shirts may wrinkle, stick to one another, and stretch significantly when handled.

One technique which has been somewhat successful has been the introduction of fiber optic edge detectors. Such detectors, when attached to a sewing machine and guide means can allow some automation of common sewing operations such as binding an edge of a pre-cut fabric piece. However, such operations still require the use of a skilled operator to feed the fabric piece to the sewing machine and usually carry out only one sewing operation at a time.

Thus, there remains a need for an apparatus for joining front and rear fabric panels to form a crotch in a pair of men's briefs or the like which can be carried out completely automatically without the need for a skilled operator.

SUMMARY OF THE INVENTION

The present invention is directed to an apparatus for forming the crotch in a garment having a front panel and a back panel which are joined at respective ends thereof to form the crotch. A holding fixture engages the front and back panels adjacent to the ends to be joined. A first positioning apparatus positions the ends of the front and back panel in their respective grippers. A second positioning apparatus aligns the edges of the front and back panels with respect to one another. After positioning the front and back panels in their respective grippers, the holding fixture positions the ends of the panels in override flapping relationship. A sewing apparatus is insertable into the holding fixture for sewing the ends of the panel together while the panels are held in the holding fixture.

In the preferred embodiment, the first positioning apparatus includes a pair of vertically moveable clamps for engaging the ends of the panels. After engaging the ends of the panels, the grippers of the holding fixture are opened and the clamps are vertically moved to position the ends of the panel. After the ends of the panels are positioned, the grippers of the holding fixture are closed to grip the panels.

Also, in the preferred embodiment, the second adjusting mechanism comprises two pair of clamps for engaging respective panels adjacent to the edges thereof. Each clamp includes an associated sensor for sensing the edge of the panel. While the front and back panels are held in the grippers, the clamps are moved until the associated sensors detect respective edges of the panels. The clamps are then closed to engage the front and back panels and the grippers of the holding fixture are opened. The clamps are then moved to position the edges of the front and back panels at a predetermined location. The grippers of the holding fixture are then closed to grip the front and back panels.

Accordingly, one aspect of the present invention is to provide an apparatus for sewing two fabric panels together along the edges thereof. The apparatus includes: (a) a pair of grippers for holding the front panel and back panel adjacent to the ends to be joined; (b) an end positioner for positioning the ends of the front and back panel in their respective grippers; (c) an edge aligning apparatus for aligning the edges of the front and back panels with respect to one another; and (d) a sewing apparatus for sewing the ends of the front and back panel together.

Another aspect of the present invention is to provide an apparatus for positioning the ends of two panels to be joined. The end position's apparatus includes: (a) a holding fixture including a pair of grippers for holding respective fabric panels adjacent to the ends to be joined; (b) actuating means for opening and closing the grippers; (c) a pair of clamps movably mounted adjacent to the grippers for engaging the ends of the fabric panels while the fabric panels are held in the grippers; (d) a sensor for sensing the position of the ends of the fabric pieces; and (e) control means operatively connected to the actuating means and the sensing means for opening the grippers and moving the clamps to position the ends of the fabric panels, and for closing the grippers when the fabric panels are positioned.

Still another aspect of the present invention is to provide an apparatus for aligning the edges of two fabric panels which are to be joined. The edge aligning apparatus includes: (a) a holding fixture including a pair of grippers for holding respective fabric panels adjacent to the ends to be joined; (b) actuating means for opening and closing the grippers; (c) first and second clamping means movably mounted adjacent the grippers for engaging respective fabric panels while the fabric panels are held in the grippers, the clamping means being movable laterally with respect to fabric panels; (d) sensing means moveable with the clamping means for sensing the edges of the fabric panel; and (e) control means operatively connected to the sensing means, the grippers, and the clamping means for opening the grippers on the holding fixture, moving the clamping means to a predetermined position to align the edges of the respective panels, and closing the grippers when the edges of the fabric panels are aligned.

These and other aspects of the present invention will become apparent to those skilled in the art after a reading of the following description of the preferred embodiment when considered with the drawings.

DESCRIPTION OF THE PREFERRED EMBODIMENTS

Figure 1A:
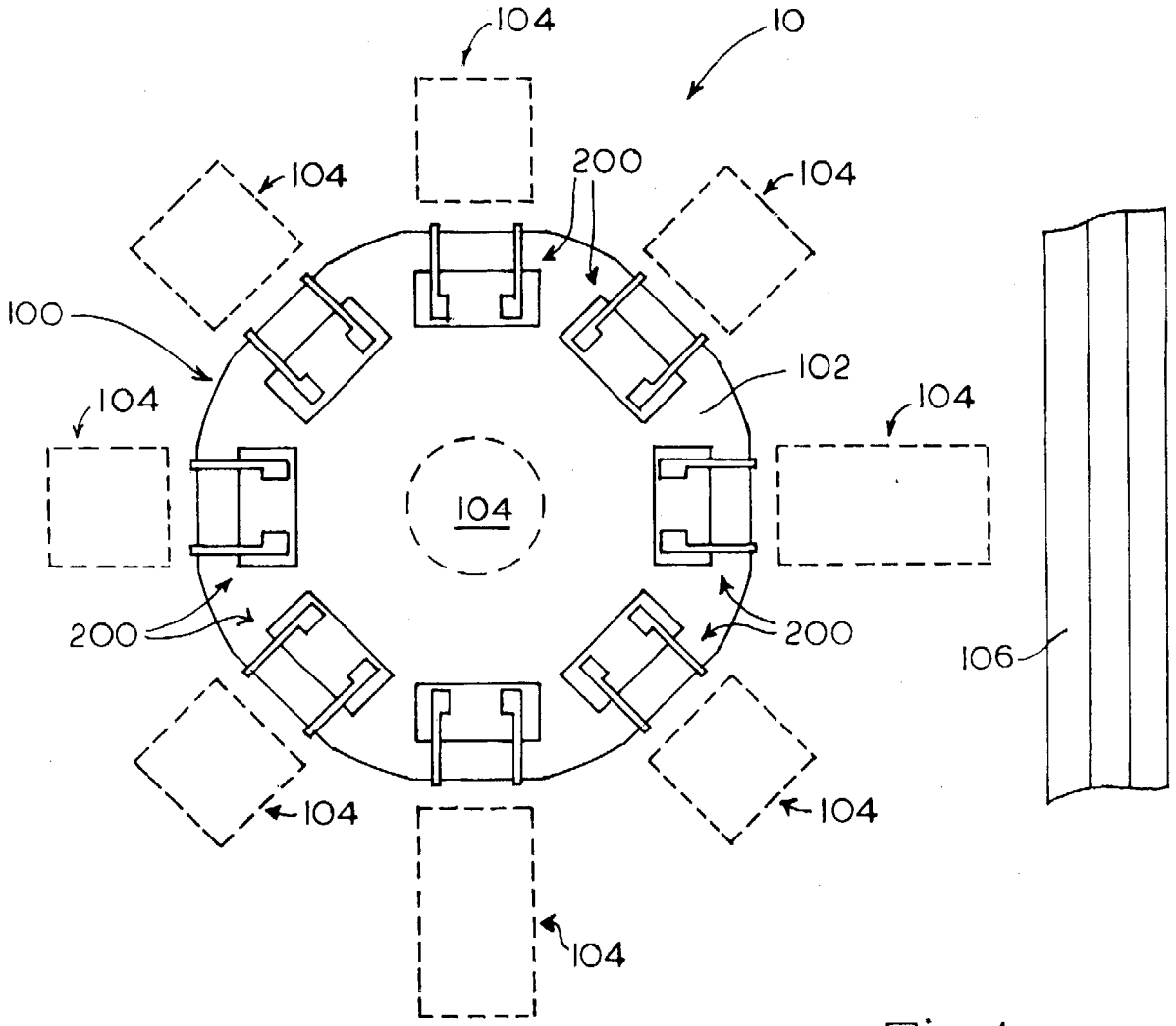
FIG. 1*a* is a schematic diagram illustrating the physical layout of the seam-crotch apparatus.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 11A:
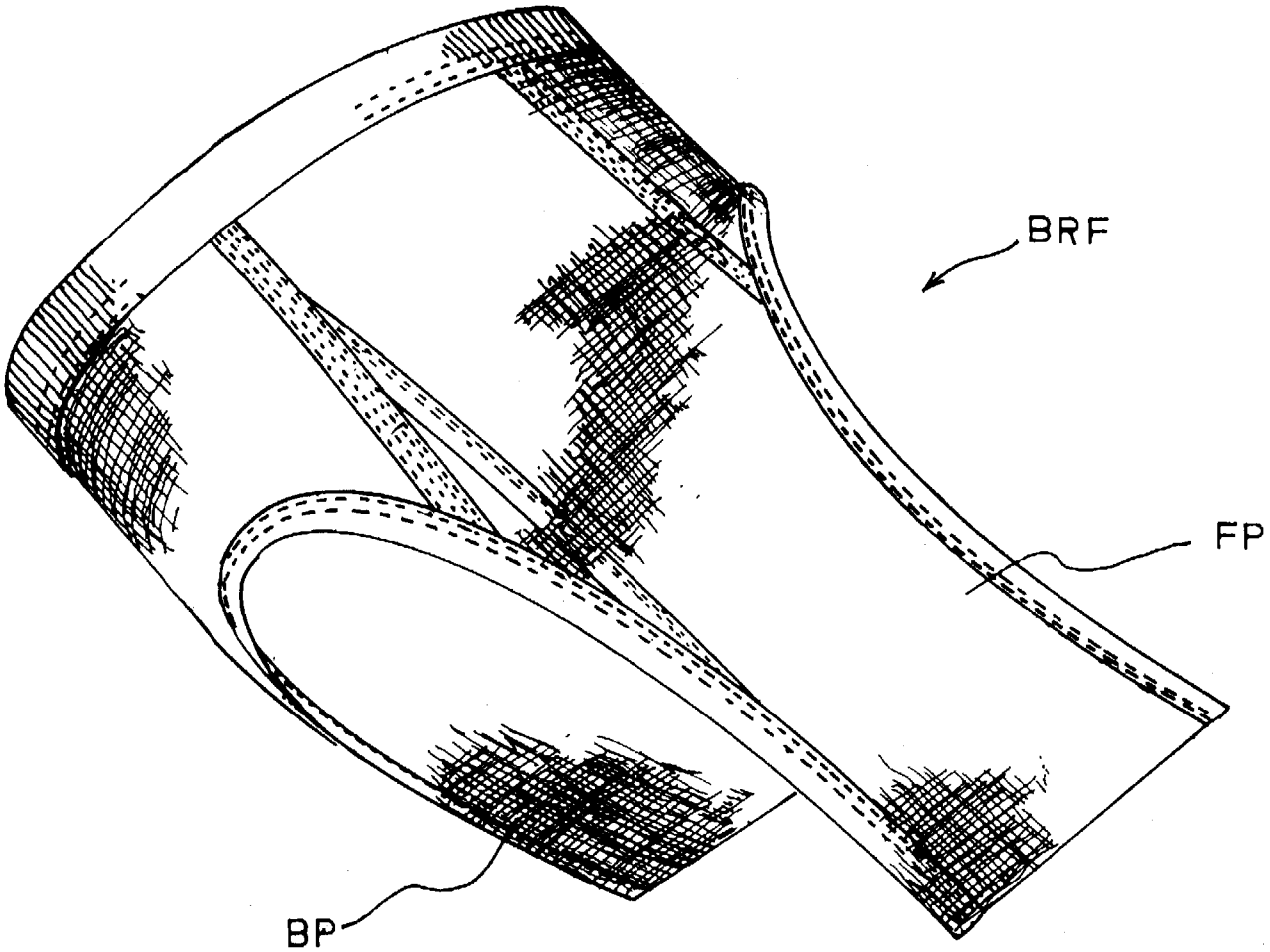
FIGS. 11*a* and 11*b* are perspective views showing a pair of men's briefs.
Figure 11B:
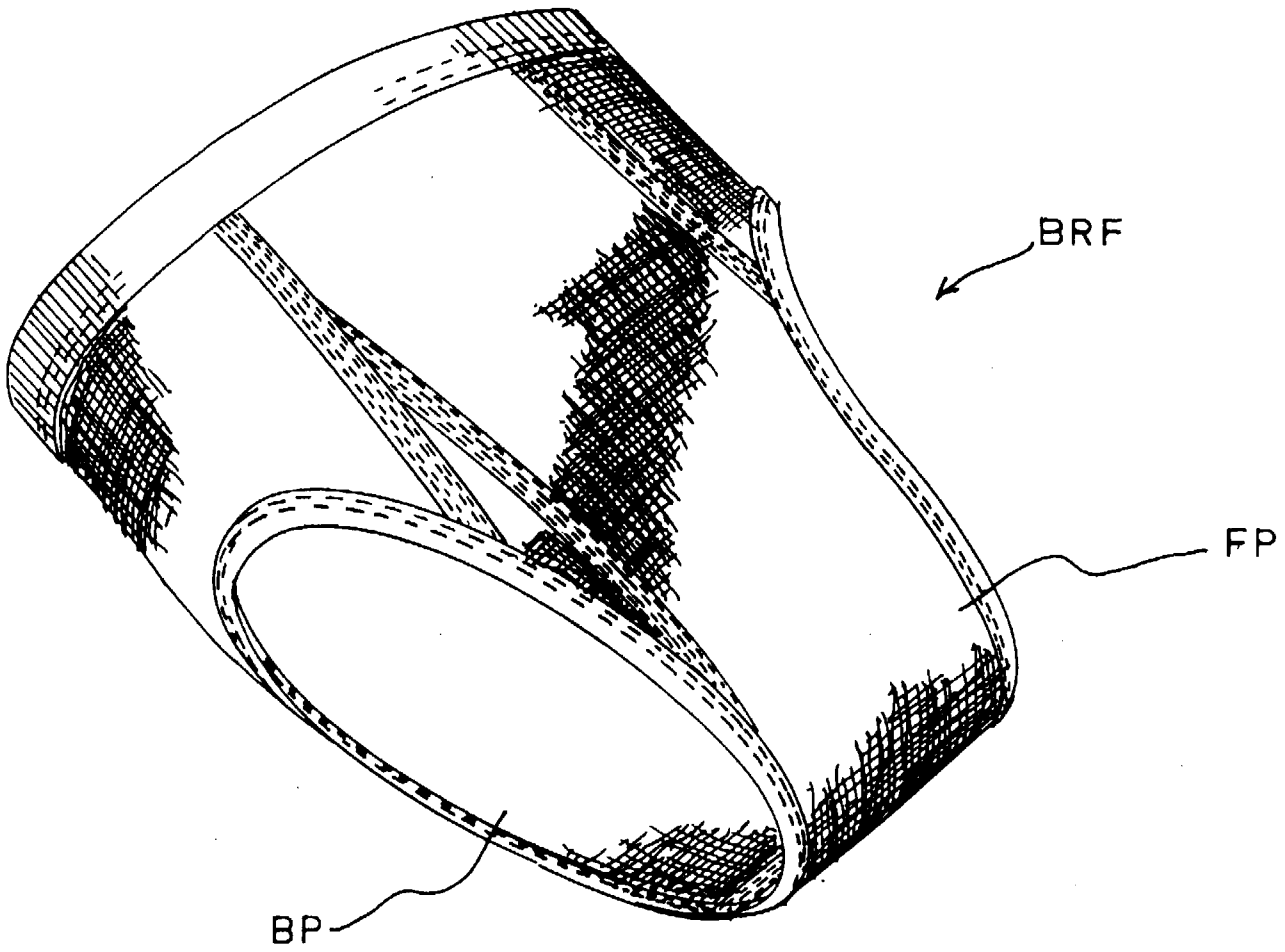

Referring now to the drawings in general and FIG. 1 in particular, it will be understood that the illustrations are for the purpose of describing a preferred embodiment of the invention and are not intended to limit the invention thereto. The seam crotch apparatus is used to form the crotch in a pair of men's briefs substantially as shown in FIG. 11. In FIG. 11, the brief is indicated generally by the designation BRF. The brief BRF is formed by sewing a front panel FP and back panel as shown in FIG. 11*a*. The free ends of the front panel FP and back panel BP are then sewn together to form the crotch, as shown in FIG. 11*b*.

Figure 1B:
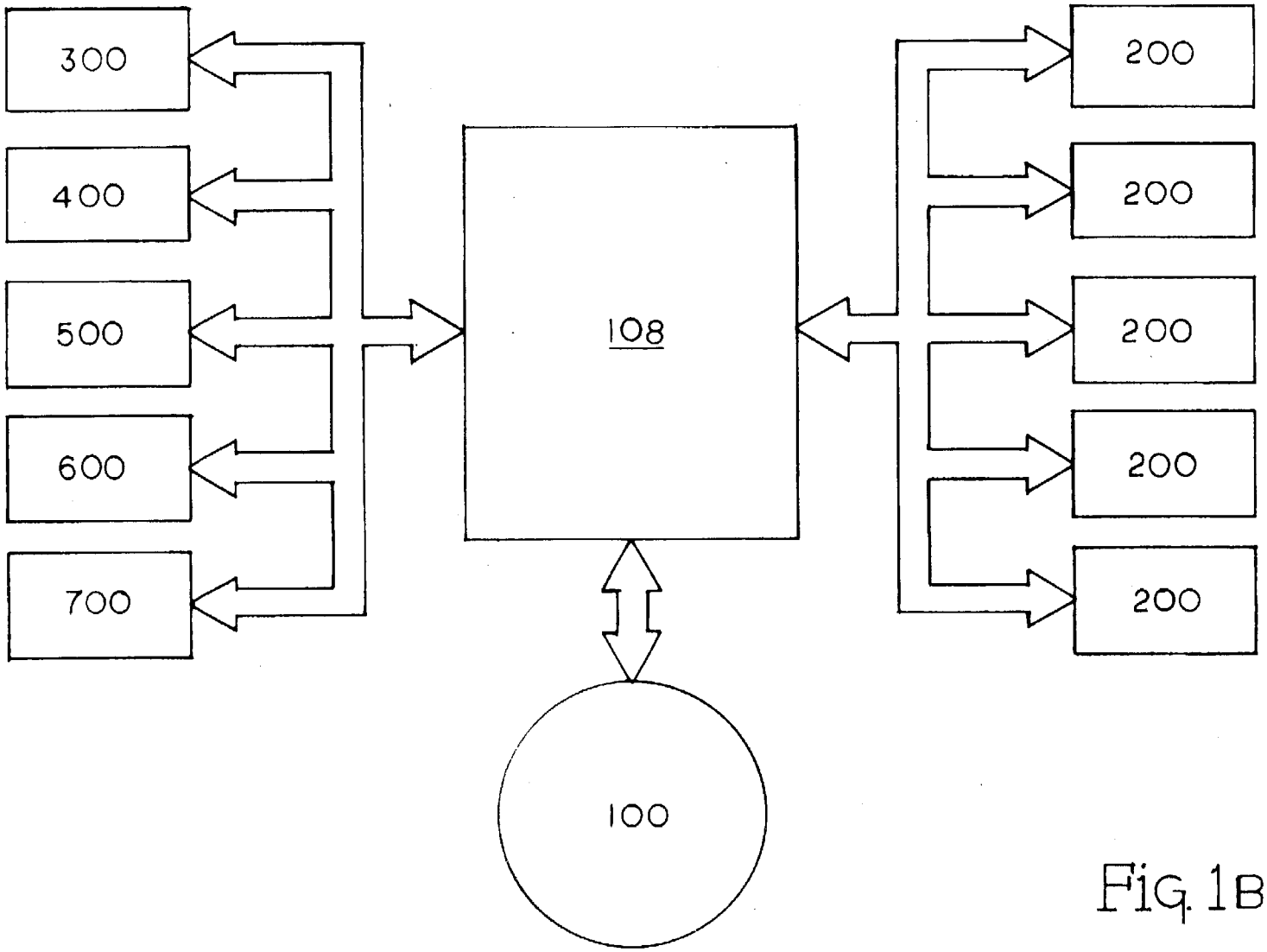
FIG. 1*b* is a schematic block diagram illustrating the major components of the seam crotch apparatus.
Figure 4:
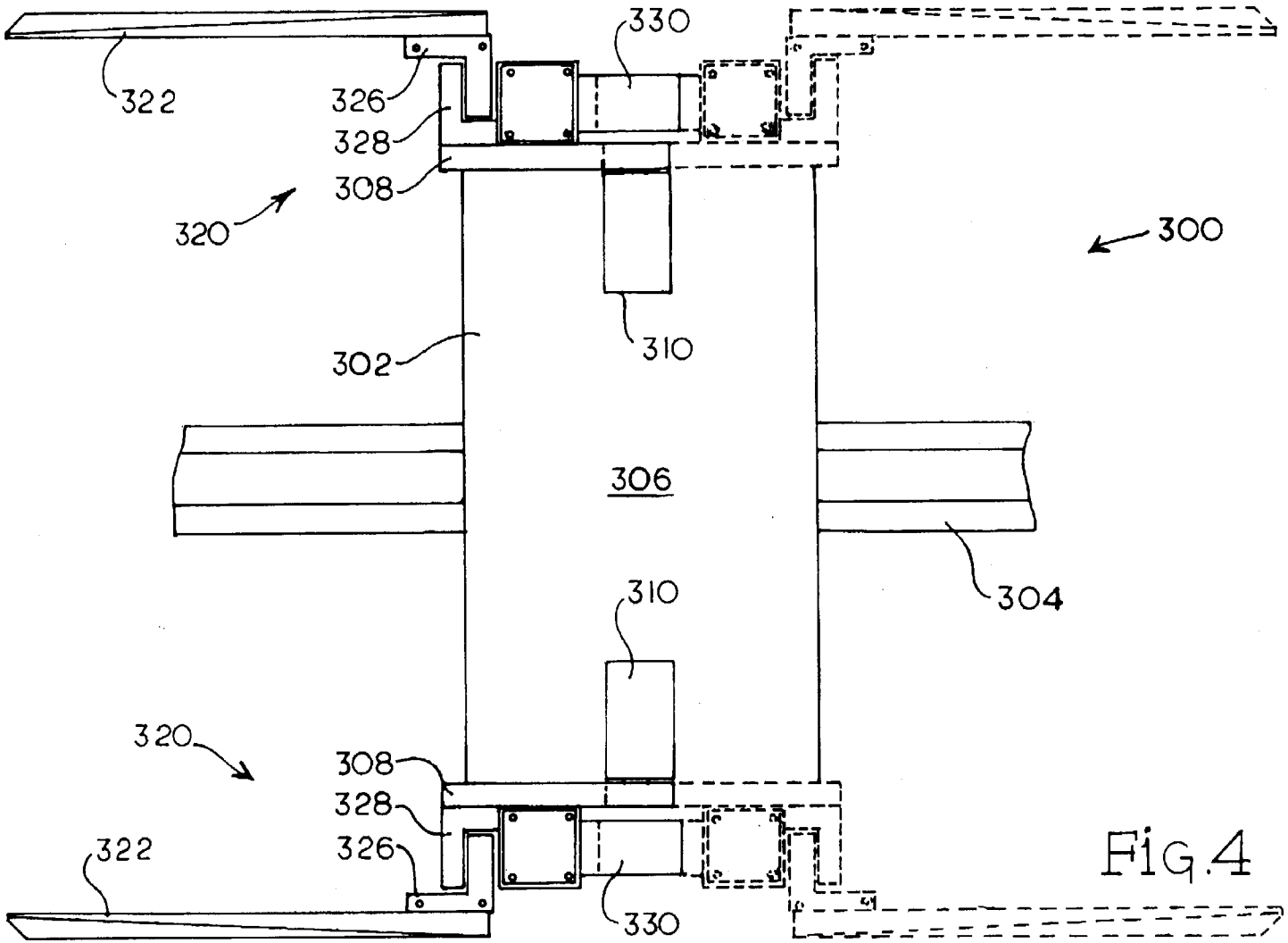
FIG. 4 is a top plan view of the transfer assembly used to transfer the pair of men's briefs to the holding fixture.

Referring now to FIGS. 1*a* and 1*b*, a seam crotch apparatus constructed according to the present invention, generally designated 10, is shown. The seam crotch apparatus 10 comprises a carousel 100 having a plurality of holding fixtures 200 mounted thereon. Each holding fixture 200 is adapted to receive and hold a pair of men's briefs. Disposed around the carousel 100 are a plurality of stations indicated generally at 104 where various operations are performed. The briefs are transported along a conveyor 106 and then transferred to the carousel 100 at one of the stations 104 by a transfer assembly 300 (FIG. 4). After the brief is transferred to the carousel 100, the carousel indexes through each of the work stations 104 while various operations are performed. A height-adjustment assembly (FIG. 6) positions the ends of the panels, an edge alignment (FIGS. 7 and 8) aligns the edges of the panels, a trimming assembly (FIG. 9) trims the ends of the panels, and a sewing assembly (FIG. 10) sews the ends of the panels together. Each of these assemblies is disposed at a respective work station 104. The carousel 100, fixtures 200, and other assemblies are all controlled by a programmable controller 108 as seen in FIG. 1*b*.

The carousel 100 comprises a large, generally circular support disk 102. The support disk 102 is rotatably mounted to an indexer 104. A plurality of holding fixtures 200 are mounted to the periphery of the support disk 102. In the embodiment shown, eight holding fixtures 200 are supported by the support disk 102. The indexer 104 rotates the support disk in fixed increments of 45° each. Thus, a total of eight stations can be placed around the carousel 100. However, in the embodiment described, only six of those stations 104 are used.

Figure 2:
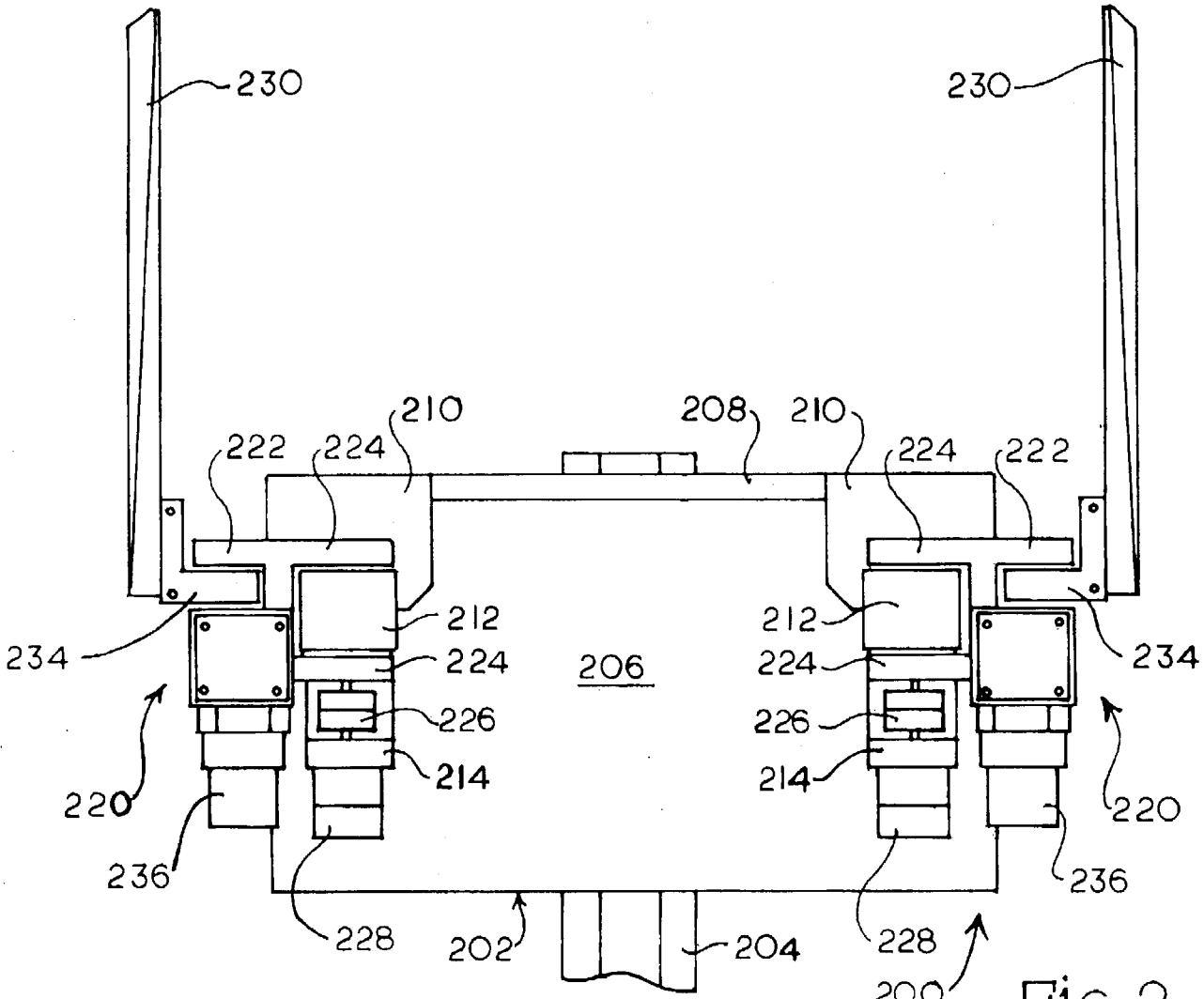
FIG. 2 is a top plan view of a holding fixture used in the seam-crotch apparatus.
Figure 3:
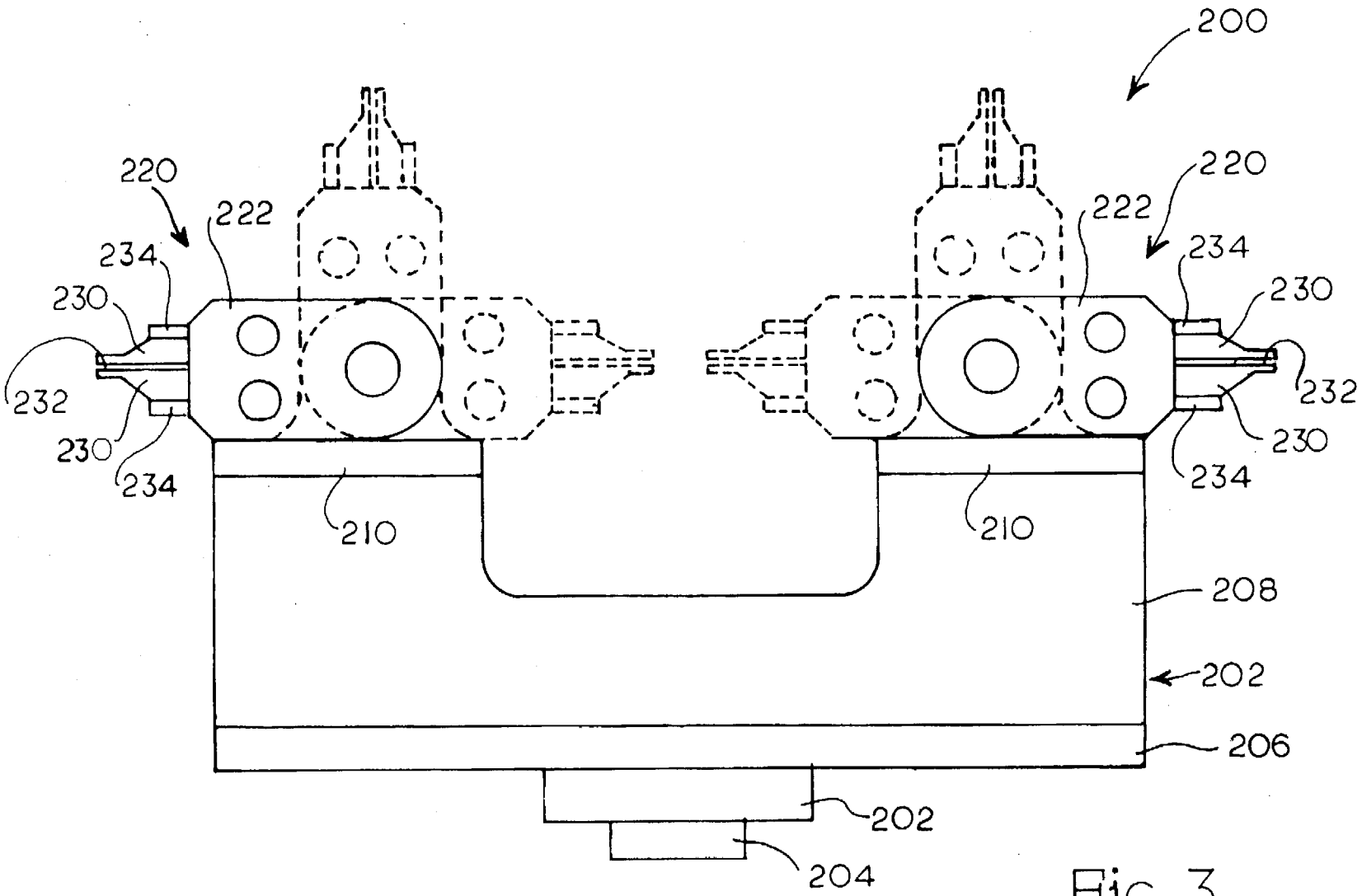
FIG. 3 is a front elevation view of the holding fixture.

Referring now to FIGS. 2 and 3, a holding fixture 200 is shown. The holding fixture 200 includes a moveable support 202 on which a pair of grippers 220 are mounted. The grippers 220 are designed to grip the ends of the front and back panels which are being joined. The moveable support 202 moves the grippers 220 forwardly and backwardly in relation to the center of the carousel 100.

The moveable support 202 comprises a moveable platform 206 which is mounted on a linear slide 204. A vertical support 208 extends upwardly from a forward edge of the moveable platform 206. A support plate 210 is disposed at each end of the vertical support 208. Support posts 212 and 214 extends upwardly from each support plate 210.

Each gripper 220 is pivotally mounted to a respective support post 212. Each gripper 220 is moveable between a receiving position, a staging position, and a sewing position. In the receiving position, the grippers 220 extend outwardly as shown in FIG. 3 while the pair of men's briefs are inserted into the fixture. In the staging position, the grippers 220 extend vertically while the brief is prepared for sewing. In the sewing position, the grippers 220 extend inwardly towards one another while the ends of the front and back panels of the men's brief is sewn together.

Each gripper 220 includes a gripper arm 222 having a pair of spaced apart extensions 224. The gripper arm 222 is rotatably mounted to the support post 212 such that the extensions 224 are disposed on opposite sides of the support post 212. One of the extensions 224 is connected by a coupling 226 to a servomotor 228. The servomotor 228 is mounted to the support post 214. The function of the servomotor 228 is to move the gripper 220 between the receiving position, the staging position, and the sewing position.

A pair of gripper fingers 230 are mounted to each gripper arm 222. The gripper fingers 230 have opposed, flat gripping surfaces 232. The gripper fingers 230 are moveable between an open position in which the gripping surfaces 232 are spaced from one another, and a closed position in which a fabric is sandwiched between the opposed gripping surfaces 232.

The gripper fingers 230 are attached at one end to a pivot plate 234. The opposite end extends forwardly and terminates at a free end. The pivot plates 234 are operatively connected to a rotary actuator 236 such that the pivot plates 234 move in opposite directions with respect to one another. Thus, actuation of the rotary actuator 236 causes the gripper fingers 230 to open and close.

The function of the holding fixture 200 is to hold the men's brief while the seam crotch operation is performed. The men's brief can be loaded into the holding fixture 200 manually or by automatic means. To receive the men's brief, the grippers 220 are disposed in the receiving position while the gripper fingers 230 are opened. The ends of the front and back panels of the men's briefs are inserted into respective grippers 220 and the gripper fingers 230 are closed to grip the front and back panels respectively. After the men's brief is received, the grippers 220 move to the staging position while preparatory steps are performed and then to the sewing position.

Referring now to FIG. 4, the transfer assembly 300 is shown for automatically transferring a pair of men's brief from an external apparatus into the holding fixture 200. The external apparatus may be another machine or holding fixture.

The transfer assembly 300 also includes a pair of grippers 320 which are mounted on a moveable support 302. The moveable support 302 includes a sliding platform 306 which is mounted on a linear slide 304. Mounted to the upper surface of the sliding platform 306 is a pivot member 308. The pivot member 308 is operatively connected to a servomotor 310. The servomotor 310 rotates the pivot member 308 about a transverse axis which is generally perpendicular to a radial of the carousel 100. Thus, the pivot member 308 swings in a generally vertical plane between a receiving position (shown in solid lines in FIG. 4) and a discharge position (shown in dotted lines in FIG. 4).

A gripper 320 is attached to the outer end of each pivot member 308. The grippers 320 are similar to the grippers 220 of the holding fixture 200. Each gripper 320 includes a pair of elongated gripper fingers 322. The gripper fingers 322 are pivotally connected by means of a pivot plate 326 to a finger support 328. The finger support 328 is fixed to the end of the swing arm 308. Each pair of gripper fingers 322 include opposed gripping surfaces for gripping the men's brief. The gripper fingers 322 are moved between an open position and a closed position by a rotary actuator 330.

Figure 5:
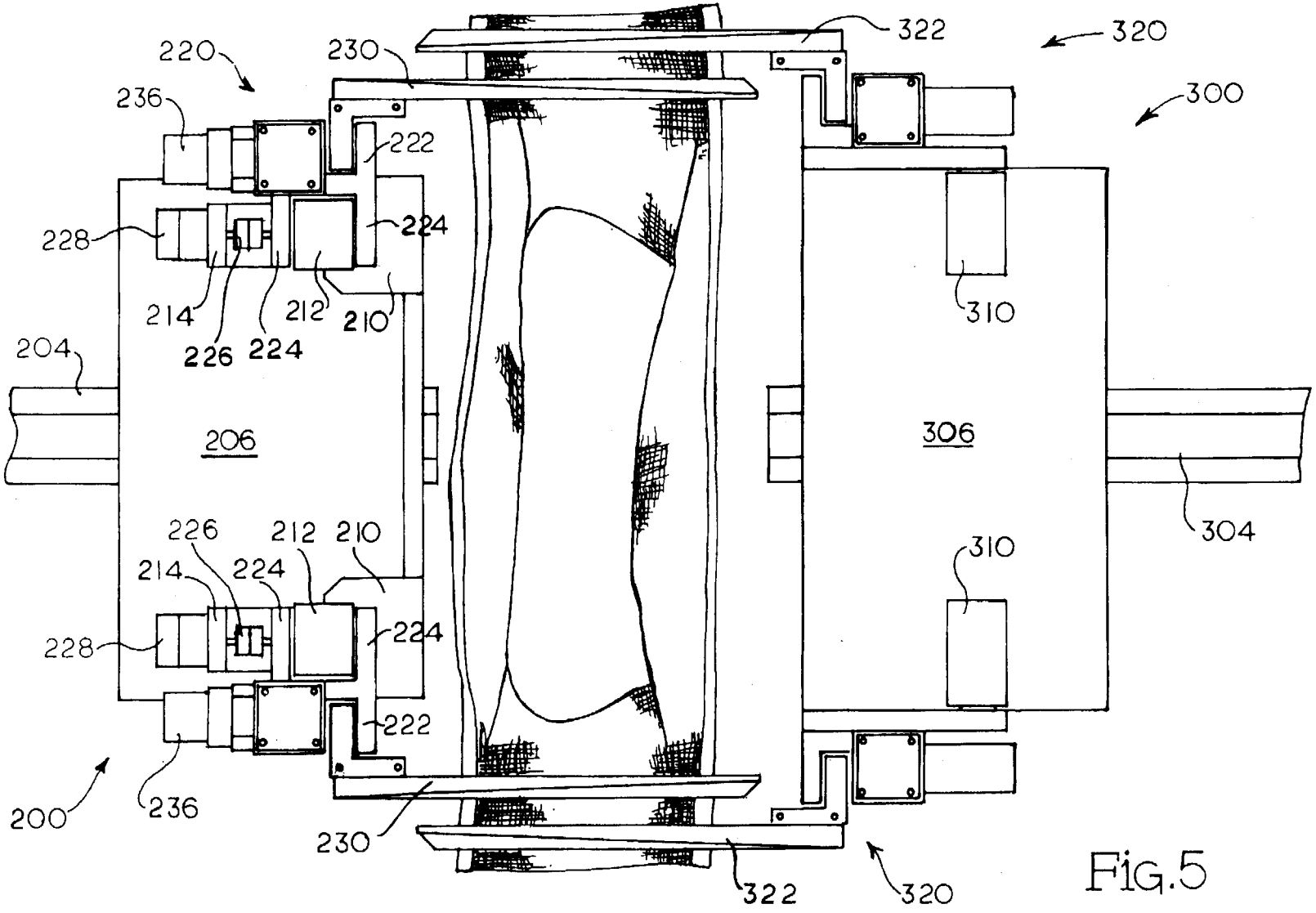
FIG. 5 is a top plan view of the holding fixture and transfer assembly illustrating how the men's brief is transferred into the holding fixture.

In operation, the gripper fingers 322 are disposed in a receiving position and are opened. While the gripper fingers 322 are open, the linear slide 304 is actuated to insert the gripper fingers 322 into a holding fixture or machine where the pair of men's brief is currently held. It is anticipated that the brief is held such that the ends of the front and back panels extend outwardly away from one another in a generally horizontal plane. The gripper fingers 322 are disposed in opposite sides of their respective panels. After insertion of the gripper fingers 322 into the holding fixture or machine, the gripper fingers 322 are closed to grip the ends of the front and back panels respectively. The linear slide 304 is again actuated to move the transfer assembly 300 to its starting position to withdraw the pair of men's brief from the holding fixture or machine. After withdrawing the pair of men's brief, servomotor 310 is actuated to swing the pivot member 308 to the discharge position shown in dotted lines in FIG. 4. In the discharge position, the gripper fingers 322 extend towards the holding fixture 200. The holding fixture 200 is then moved from a retracted position to an extended position as shown in FIG. 5. While the holding fixture 200 is moved to the extended position, the grippers 220 are disposed in a receiving position with the gripper fingers 230 in an open position. As the holding fixture 200 is moved forwardly, the ends of the front and back panels are inserted between respective pairs of gripper fingers 230 on the holding fixture 200. The gripper fingers 230 of the holding fixture 200 are then closed and the gripper fingers 322 of the transfer assembly 300 are opened. The holding fixture 200 is then moved back to the retracted position and the transfer of the brief is complete.

After the brief is transferred to the holding fixture 200, a series of operations are performed ending with the step of sewing the ends of the front and back panels together. These steps include: (1) positioning the ends of the front and back panels; (2) aligning the edges of the front and back panels; (3) trimming the ends of the front and back panel; and (4) sewing the ends of the front and back panels together.

Each of these operations is performed at a separate station 104. After each operation, the carousel 100 is indexed so that the next operation can be performed. Because the carousel 100 includes eight separate holding fixtures 200, each operation is performed simultaneously on different pairs of men's briefs.

Figure 6:
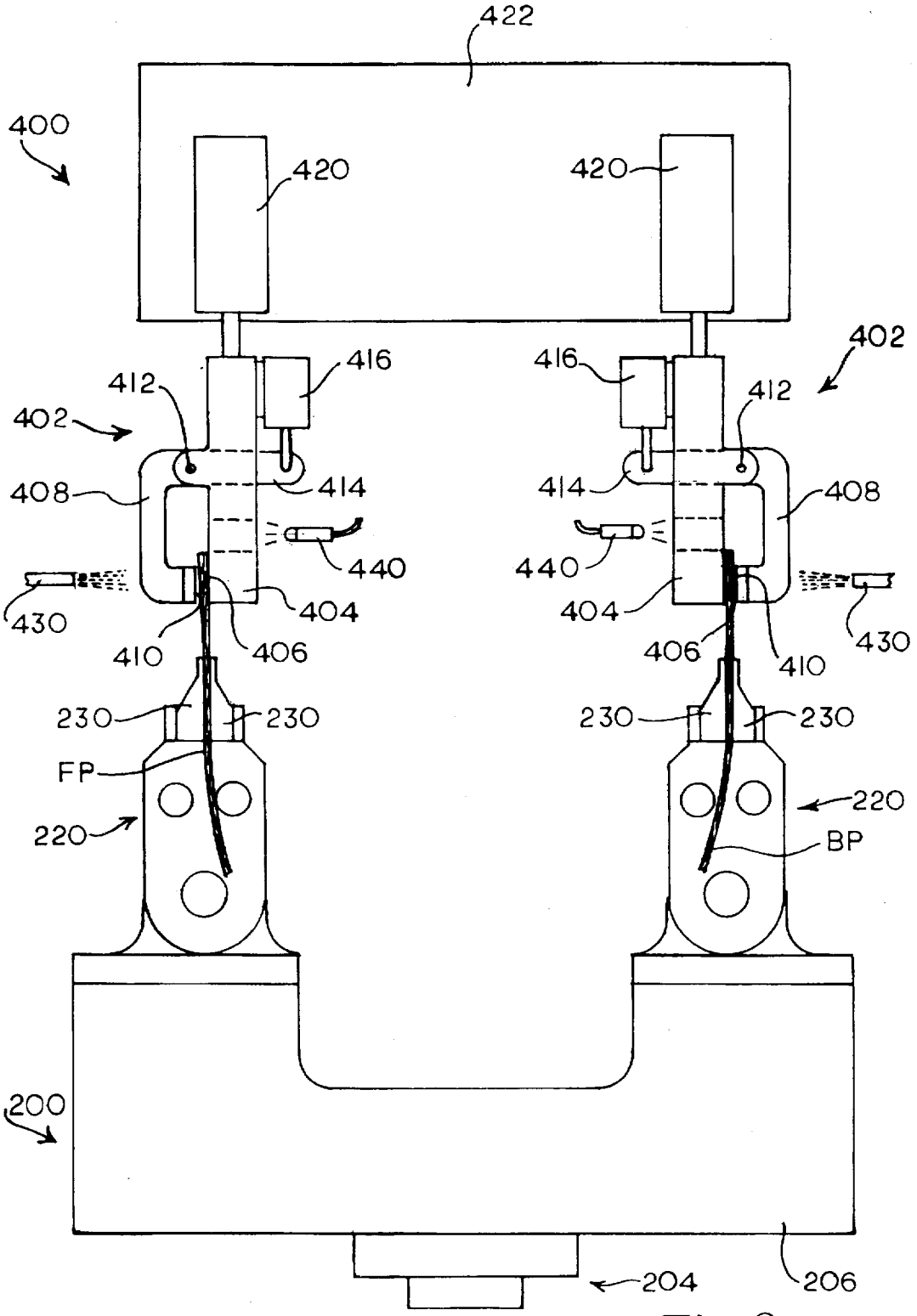
FIG. 6 is a front elevation view of the holding fixture in height adjustment assembly.

FIG. 6 illustrates the height-adjustment mechanism for positioning the ends of the front and back panels in their respective grippers 220. This adjustment is made while the grippers 220 are disposed in a vertical position as shown in FIG. 6. The height-adjustment mechanism 400 includes a pair of adjusting clamps 402 for gripping the ends of the front and back panels. The adjusting clamps 402 are mounted on vertical slides 420 which are operative to raise and lower the adjustable clamps 402. The vertical slides 420 are mounted on a frame member 422.

Each adjustable clamp 402 includes a stationary jaw 404 and a moveable jaw 408. The stationary jaw 404 and moveable jaw 408 have opposed clamping surfaces 406 and 410 for gripping the fabric. The moveable jaw 408 is connected to the stationary jaw 404 by a pivot pin 412. The moveable jaw 408 includes an extension 414 which is connected to a cylinder 416. The cylinder 416 is operative to pivot the moveable jaw 408 between open and closed positions.

In operation, the clamps 402 grip the ends of the front and back panels respectively. An air jet 430 is used to lift the ends of the front and back panels to enable the clamps 402 to grip the ends thereof. A blast of air 430 is directed underneath the ends of the front and back panel to raise the ends. The moveable jaw 408 is then closed to grip the end of the panel. The grippers 220 are then opened to release the front and back panels. While the grippers 220 are opened, the vertical slide is actuated to raise or lower its associated clamp 402 until the end of the front and back panel is detected by respective sensors 440. The grippers 220 are then closed and the adjusting clamps 402 are opened.

Figure 7:
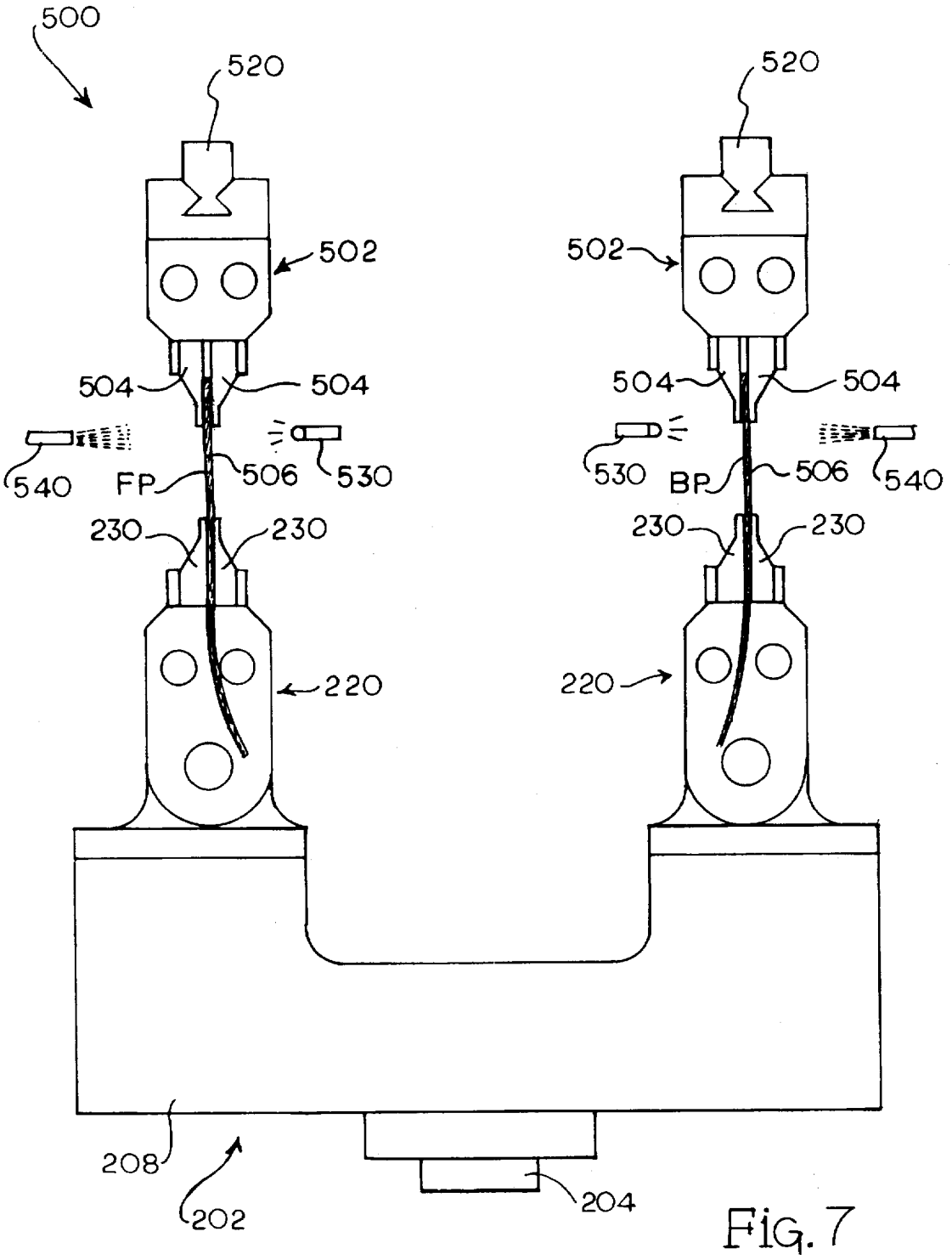
FIG. 7 is a elevation view of the holding fixture and edge alignment assembly.

After the ends of the front and back panels are positioned in their respective grippers 220, the right and left edges of the two panels must be aligned. The edge alignment assembly 500 for aligning these edges is shown in FIGS. 7 and 8. The edge alignment mechanism 500 includes two pairs of clamps 502. Each pair of clamps 502 is mounted to a track 520 which are disposed above the carousel 100. The clamps 502 slide in a direction parallel to a radial of the carousel 100. Each clamp 502 includes opposed gripper fingers 504 which are opened and closed by a rotary actuator (not shown).

Each clamp 502 includes an associated sensor 530 which is fixed to the clamp 502. The function of the sensors 530 is to detect a respective edge of the front or back panel. An air jet 540 provides a blast of air which raises the ends of the front and back panels to enable the clamps 502 to grip the panels.

Figures 8A, 8B:
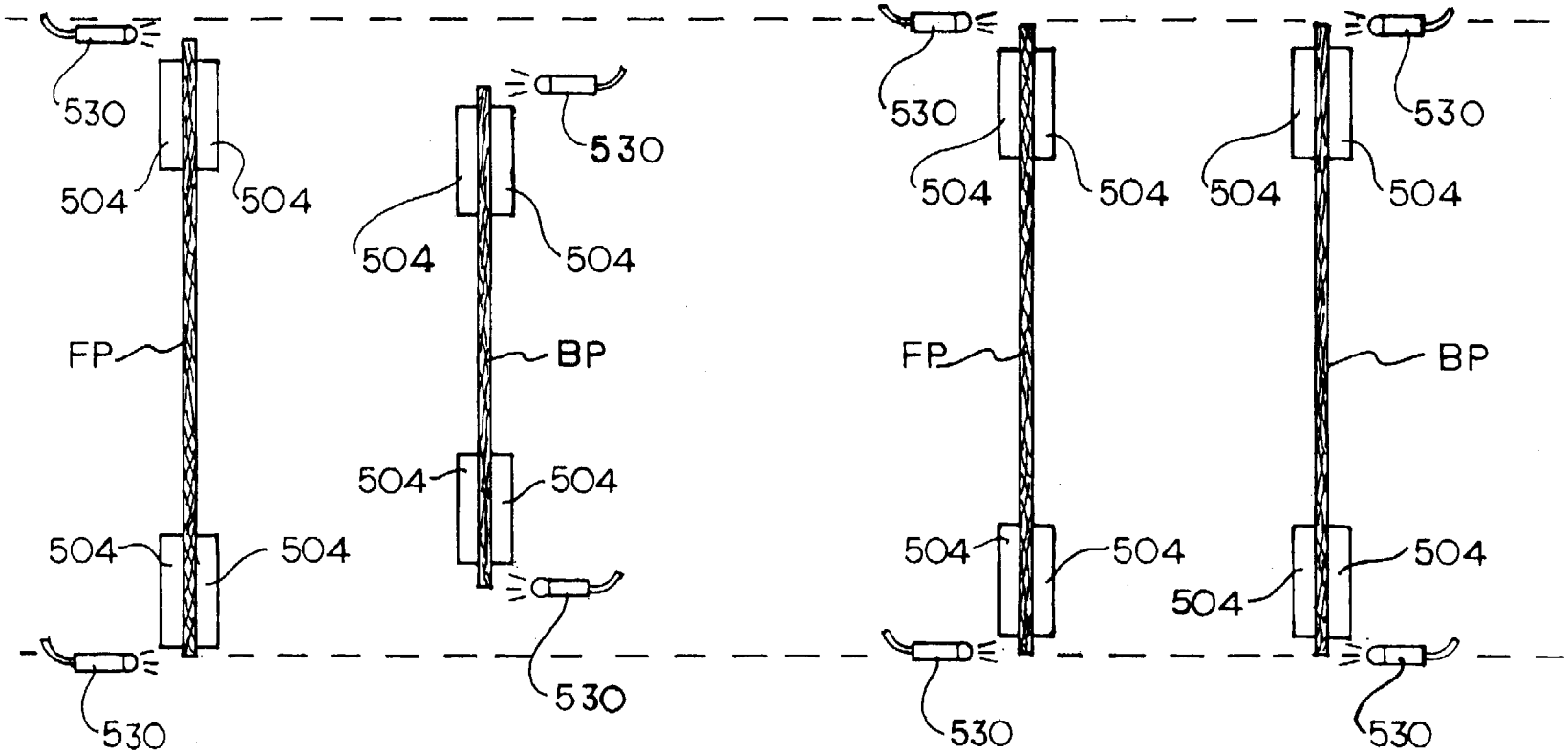
FIGS. 8*a* and 8*b* are schematic diagrams illustrating the operation of the edge alignment assembly.

Referring now to FIGS. 8*a* and 8*b*, the operation of the edge alignment assembly 500 is shown in diagrammatic form. The clamps 502, which are initially open, slide along their respective tracks 520 until the edges of the front and back panels are detected by the sensor 530. One pair of clamps 502 clamps adjacent the right and left edges of the front panel FP. The opposite set of clamps 502 clamp the right and left edges of the back panel BP. After the edges of the front and back panels are located and clamped as shown in FIG. 8*a*, the grippers 220 of the holding fixture open. The clamps 502 then slide along their respective linear slides 520 to a predetermined, fixed location as shown in FIG. 8*b*. In this location, the right and left edges of the front and back panels are aligned with one another. The grippers 220 on the holding fixture 200 then close to clamp the front and back panels in the newly aligned position.

Figure 9:
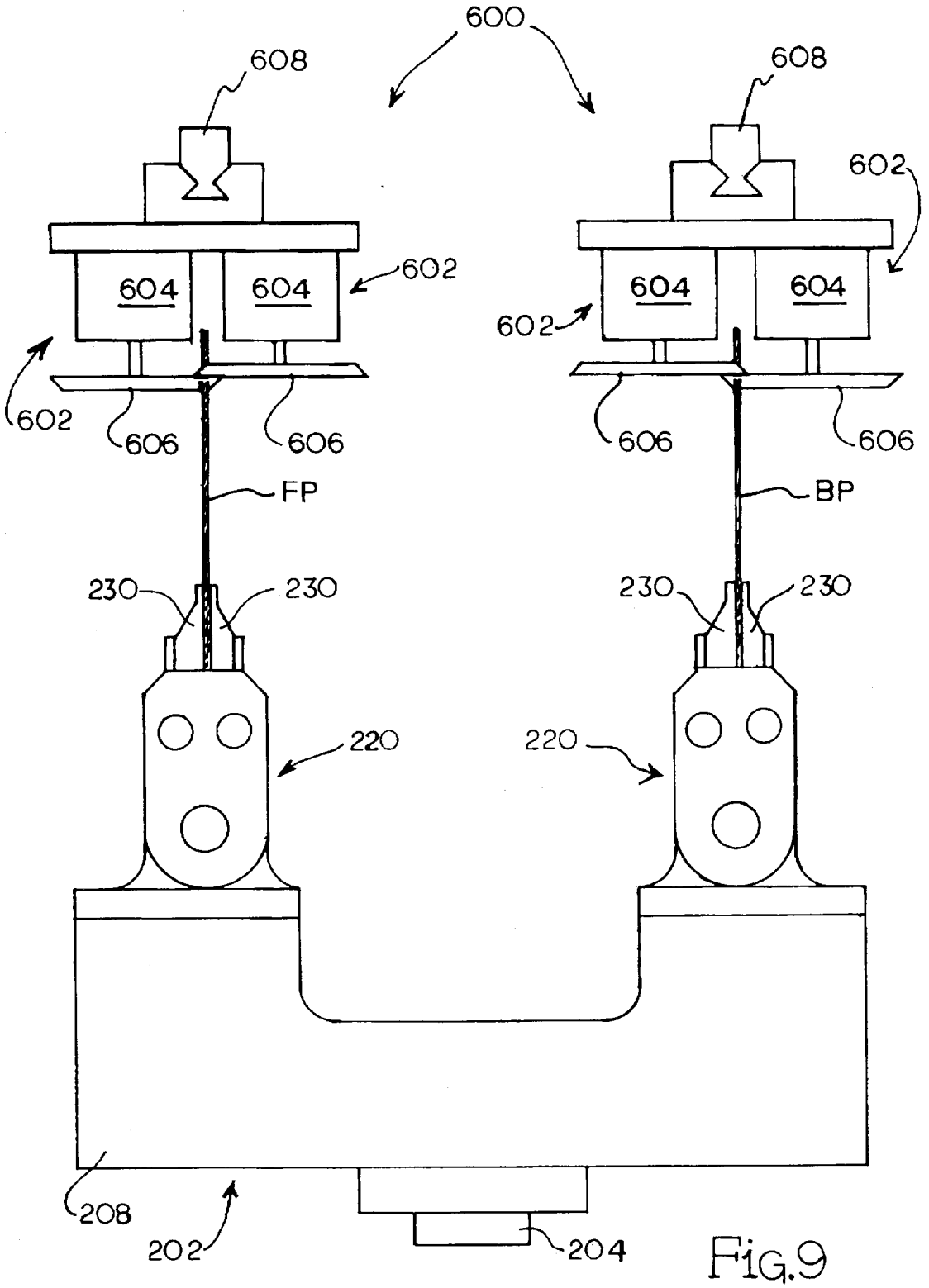
FIG. 9 is an elevation view of the holding fixture and trimming apparatus.
Figure 10:
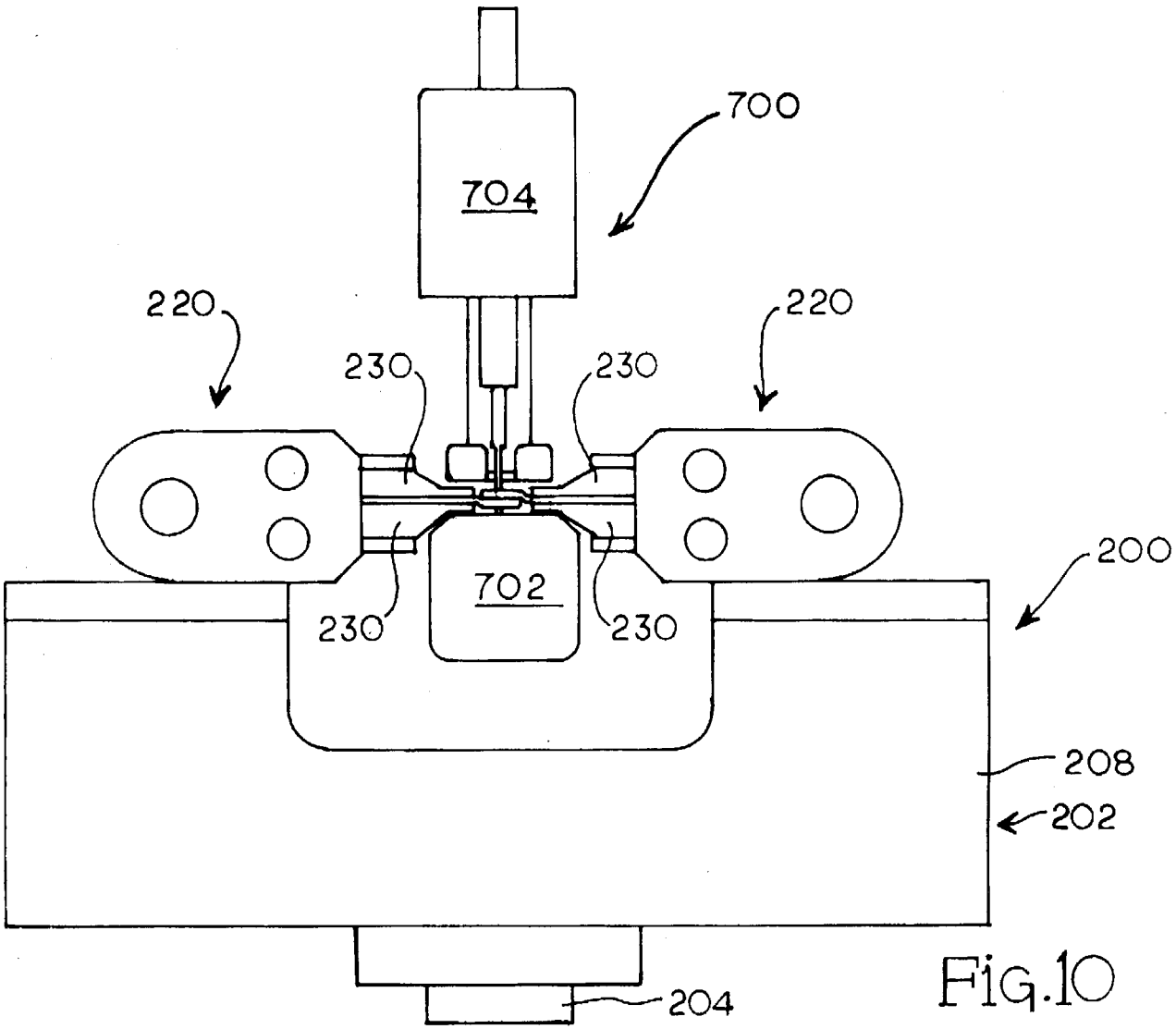
FIG. 10 is an elevation view of the holding fixture and sewing apparatus.

After aligning the edges of the front and back panels, the next step in the operation is trimming the edges of the front and back panels. The trimming apparatus 600 for performing this operation is shown in FIG. 9. The trimming apparatus 600 includes a pair of trimmers 602 which are mounted for longitudinal movement on a track 608. Each trimmer 602 includes a motor 604 and a circular blade 606. The trimmers 602 are spaced apart from one another such that the blades 606 overlap slightly.

In operation, the trimmers 602 travel along the track 608 in synchronization with the tangential cutting speed of circular blades 600 to trim the ends of the panels. The ends of the panels pass through the nip between the circular blades 606 and are severed. This operation ensures that the ends of the front and back panels will be squared before they are joined.

The final operation is the step of sewing the front and back panels together. To sew the ends of the front and back panels together, a conventional off-arm sewing machine 700 is used. (FIG. 10) The construction and operation of off-arm sewing machines is well-known to those skilled in the art. The sewing machine 700 is mounted in a fixed position adjacent to the carousel. The sewing machine 700 includes a sewing arm 702 and a sewing head 704.

To perform the sewing operation, the holding fixture 200 is moved from its retracted position to an extended position while the grippers 220 are in a vertical position. The extension of the holding fixture disposes the grippers 220 on opposite sides of the sewing arm 702. The grippers 220 are then rotated to the sewing position such that the ends of the front and back panel are disposed on top of the sewing arm 702. The holding fixture 200 then moves back towards the retracted position while the sewing machine 700 sews the front and back panels together. The motion of the holding fixture 200 during sewing is synchronized to the sewing machine motion via a servomotor. This completes the seam-crotch operation.

After sewing the ends of the front and back panels together, the carousel 100 rotates the holder 200 to the discharge position where the pair of men's brief is removed from the holder. The brief may be removed by either manual or automatic means. For example, a transfer assembly similar to the assembly shown in FIG. 3 can be used to off-load the men's brief.

Based on the foregoing, it is apparent that the seam-crotch apparatus 10 provides an automated mechanism for forming the crotch in a pair of men's briefs. The seam-crotch apparatus 10 reduces labor costs and increases production rates associated with the production of men's underwear. Further, the seam crotch apparatus reduces the number of defects as compared to manual sewing operations.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for positioning the ends of two fabric panels which are to be joined, said apparatus comprising:

(a) a holding fixture including a pair of grippers for holding respective fabric panels adjacent to the ends to be joined;

(b) actuating means for opening and closing the grippers;

(c) a pair of clamps movably mounted adjacent to said grippers for engaging the ends of the fabric panels while the fabric panels are held in said grippers;

(d) a sensor for sensing the position of the ends of the fabric pieces; and (e) control means operatively connected to the actuating means and the sensing means for opening said grippers and moving said clamps to position the ends of the fabric panels, and for closing said grippers when the fabric panels are positioned.

2. The apparatus according to claim 1 wherein said clamp includes a stationary jaw and a movable jaw having opposed clamping surfaces for clamping the fabric panel between said opposed clamping surfaces.

3. The apparatus according to claim 2 wherein said movable jaw is pivotally connected to said stationary jaw.

4. The apparatus according to claim 3 wherein said clamps are mounted for vertical movement relative to the holding fixture and wherein said grippers on said holding fixture are disposed to hold the ends of the fabric panels in a generally vertical position.

5. The apparatus according to claim 4 further included an air jet disposed adjacent the grippers of the holding fixture to direct air towards said fabric panels to assist in holding said ends in a vertical position.

6. An apparatus for aligning the edges of two fabric panels which are to be joined, said apparatus comprising:

(a) a holding fixture including a pair of grippers for holding respective fabric panels adjacent to the ends to be joined;

(b) actuating means for opening and closing the grippers;

(c) first and second clamping means movably mounted adjacent the grippers for engaging respective fabric panels while the fabric panels are held in said grippers, said clamping means being movable laterally with respect to fabric panels;

(d) sensing means moveable with said clamping means for sensing the edges of the fabric panel; and (e) control means operatively connected to the sensing means, the grippers, and the clamping means for opening said grippers on said holding fixture, moving said clamping means to a predetermined position to align the edges of the respective panels, and closing said grippers when the edges of the fabric panels are aligned.

7. The apparatus according to claim 6 wherein each said clamping means comprises a pair of clamps for engaging the fabric panel adjacent respective edges of the fabric panel.

8. The apparatus according to claim 7 wherein the sensing means comprises a sensor mounted to said clamps for detachably respective edges of the fabric panel.

9. A method for positioning the ends of two fabric panels which are to be joined, said method comprising the steps of:

(a) holding respective fabric panels adjacent to the ends to be joined in a holding fixture including a pair of grippers;

(b) engaging the ends of the fabric panels while the fabric panels are held in said grippers in a pair of clamps movably mounted adjacent to said grippers;

(c) sensing the position of the ends of the fabric pieces; and (d) opening said grippers and moving said clamps to position the ends of the fabric panels and closing said grippers when the fabric panels are positioned.

10. A method for forming the crotch in a garment having a front panel and a back panel which are joined at respective ends thereof to form the crotch, said method comprising the steps of:

(a) holding the front and back panels adjacent to the ends to be joined in a holding fixture including a pair of grippers;

(b) engaging the front and back panels while the front and back panels are held in said grippers in first and second clamping means movably mounted adjacent the grippers, said clamping means being movable laterally with respect to fabric the front and back panels;

(c) sensing the edges of the the front and back panels; and (d) opening said grippers on said holding fixture, moving said clamping means to a predetermined position to align the side edges of the front and back panels, and closing said grippers when the side edges of the front and back panels are aligned.

* * * * *

UNITED STATES PATENT AND TRADEMARK OFFICE

CERTIFICATE OF CORRECTION

PATENT NO. : 5,722,337

DATED : March 3, 1998

INVENTOR(S) : Donald E. Burt et al.

It is certified that error appears in the above-indentified patent and that said Letters Patent is hereby corrected as shown below:

Column 8, line 12,

In Claim 10, section (b), line 5, "fabric" should be deleted after the word to.

Signed and Sealed this

Twenty-eighth Day of April, 1998

Bruce Lehman

*Attest:*

BRUCE LEHMAN

*Attesting Officer*

*Commissioner of Patents and Trademarks*